United States Patent [19]

Biasini

[11] 4,360,183

[45] Nov. 23, 1982

[54] RETAINING DEVICE FOR SHEET MUSIC

[75] Inventor: Americole R. Biasini, Bellingham, Wash.

[73] Assignee: Allsop, Inc., Bellingham, Wash.

[21] Appl. No.: 162,520

[22] Filed: Jun. 24, 1980

[51] Int. Cl.[3] ..... A47B 97/04

[52] U.S. Cl. ..... 248/451; 248/441 A

[58] Field of Search ..... 248/441 A, 451, 452, 248/453

[56] References Cited

U.S. PATENT DOCUMENTS

| | | | |
|---|---|---|---|
| 294,498 | 3/1884 | Parker | 248/452 |
| 356,826 | 2/1887 | Ferguson | 248/453 |
| 449,555 | 6/1893 | Lehmann | 248/453 |
| 774,814 | 11/1904 | Adams | 248/451 |
| 3,073,056 | 1/1963 | Russell | 248/441 A X |
| 3,863,882 | 2/1975 | Hatcher | 248/441 A X |
| 4,047,688 | 9/1977 | Knox et al. | 248/451 |

*Primary Examiner*—William H. Schultz

*Attorney, Agent, or Firm*—Hughes, Barnard & Cassidy

[57] ABSTRACT

A device adapted to be mounted to a conventional music stand to hold sheet music to the back panel of the stand. The device has a mounting portion comprising upper and lower hinge connected mounting flanges that grip the support flange of the music stand. The device has a transparent retaining arm connected to the upper mounting flange and extending upwardly therefrom to engage the sheet music with moderate pressure. A spring clip is positioned over the mounting portion to cause firm gripping action.

7 Claims, 5 Drawing Figures

RETAINING DEVICE FOR SHEET MUSIC

BACKGROUND OF THE INVENTION

The present invention relates to a device to hold sheet music against a music stand, and more particularly to such a device which can readily be used with a conventional music stand.

For many decades, perhaps even a century or more, musicians have had the problem of how to reliably hold their sheet music in place. For example, present day music stands generally have three main component parts, namely: a. a back panel against which the sheet music rests, b. a lower support flange which engages the lower edge of the sheet music, and c. a support column or the like which supports the panel and support flange. The problem of keeping the sheet music on the stand becomes particularly difficult when used in an outdoor environment. It is not uncommon to see musicians use a half-dozen clothespins or similar retaining devices, and place these around the periphery of the stand to hold the edges of the sheet music, so as to leave an unimpaired view of the sheet music itself. Not only is this multiplicity of retaining devices cumbersome (particularly when it is necessary to change sheet music), but these retaining devices are quite visible to the audience and take away something of the aesthetic appeal of an orchestral setting.

A search of the United States patent literature discloses a number of devices for retaining sheet music, of books or the like. Typical of these are the following:

U.S. Pat. No. 255,649, Merrill, shows a music holder where there are a pair of arms mounted to a slotted plate. The arms can be moved along the slot to various positions to hold the sheet music.

U.S. Pat. No. 290,381, Wood, shows a book holder having a pair of spring-like tongue elements mounted to a structure and adapted to hold the cover of the book. There are two other spring arms having pads on the end to hold the pages of the book.

U.S. Pat. No. 818,579, Swope, discloses what is called a "copyholder" disclosing a base plate having a pair of spring loaded arms mounted thereto. The spring loaded arms are made integral with coil springs which provide the spring actions, and these arms engage the copy.

U.S. Pat. No. 1,360,718, Bromley, discloses a book rest where there are a pair of arms formed integrally with lower coil springs, so that the arms yieldingly engage the book. These are in turn mounted to a horizontal base board.

U.S. Pat. No. 1,947,053, Mason, discloses a book holder where there are a pair of bracket clips mounted to a rest member of a stand. The clips are mounted by a pair of extension arms which fit against the bottom side of the rest member and are retained in that position by bracket bearings.

U.S. Pat. No. 3,809,352, Mathias, shows a "book holder and shield" which is made of a shield of transparent synthetic resin. There is a rear support panel formed integrally with a transparent holding and viewing panel that is positioned in front of the book being held.

U.S. Pat. No. 4,150,807, Manso, shows a book holding device where there is a main support panel and a pair of wire hooks mounted over the top side of the panel. These hooks engage the top edge of the book pages.

In view of the foregoing, it is an object of the present invention to provide an effective and relatively simple holding device for sheet music, which holding device can be quite conveniently and quickly mounted to a conventional music stand in a manner to reliably hold the sheet music in place, while permitting full visibility of the sheet music. Other objects and advantages will become apparent from the detailed description which follows.

SUMMARY OF THE INVENTION

The retaining device of the present invention is adapted to be mounted to a music stand, where the music stand has a back panel portion and a lower support flange extending outwardly from the lower part of the panel portion. The device is so constructed that it can readily be mounted to, or removed from, the stand to permit the change of sheet music, and when in its retaining position, the device reliably holds the sheet music in place without obstructing visiblity of the sheet music.

The device comprises a retaining arm having an upper end and a lower end. The retaining arm is adapted to be located in an upright retaining position against sheet music positioned on the stand.

The device has a mounting means, comprising an upper and a lower mounting flange. The upper mounting flange has an inner end connected to the lower end of the retaining arm and an outer end extending outwardly from the retaining arm. The lower mounting flange has an outer end operatively connected to the outer end of the upper mounting flange, and an inner end extending toward the inner end of the upper mounting flange.

The upper mounting flange is adapted to be positioned over the support flange of the stand, while the lower mounting flange is adapted to be positioned immediately below the support flange of the stand. The two mounting flanges are arranged to grip the support flange in a manner to hold the retaining arm in its retaining position against sheet music positioned on the music stand.

Desirably, the lower mounting flange connects to the upper mounting flange about a hinge connection which permits limited rotational movement between the two mounting flanges. In a preferred form, this is a tongue and groove connection, with a lip being formed on one of the mounting flanges and a matching groove in the other one of the mounting flanges. In this preferred form, spring means is provided to urge the mounting flanges toward one another. In this particular embodiment, the spring means is in a form having two spring arms joined one to another by a spring base member. One upper spring arm presses downwardly against the upper mounting flange, while the lower spring arm presses upwardly against the lower mounting flange. At least one of the mounting flanges has a groove to receive one of the spring arms, and desirably both of the mounting flanges have such grooves.

Preferably, the retaining arm and the upper mounting flange are formed of plastic as one integral piece, with at least the retaining arm being made at least translucent (and preferably transparent) so that an unobstructed view of the sheet music is provided. The lower mounting flange is formed as a separate piece of plastic to be hinge connected to the upper mounting flange. Desirably, the spring member is made of resilient steel or some other metal which has sufficient strength to urge the flanges together with adequate force, and which can be sprung open and shut within moderate limits a great number of times without experiencing fatigue.

Other features of the invention will become apparent from the following detailed description.

DESCRIPTION OF THE PREFERRED EMBODIMENT

Figure 1:
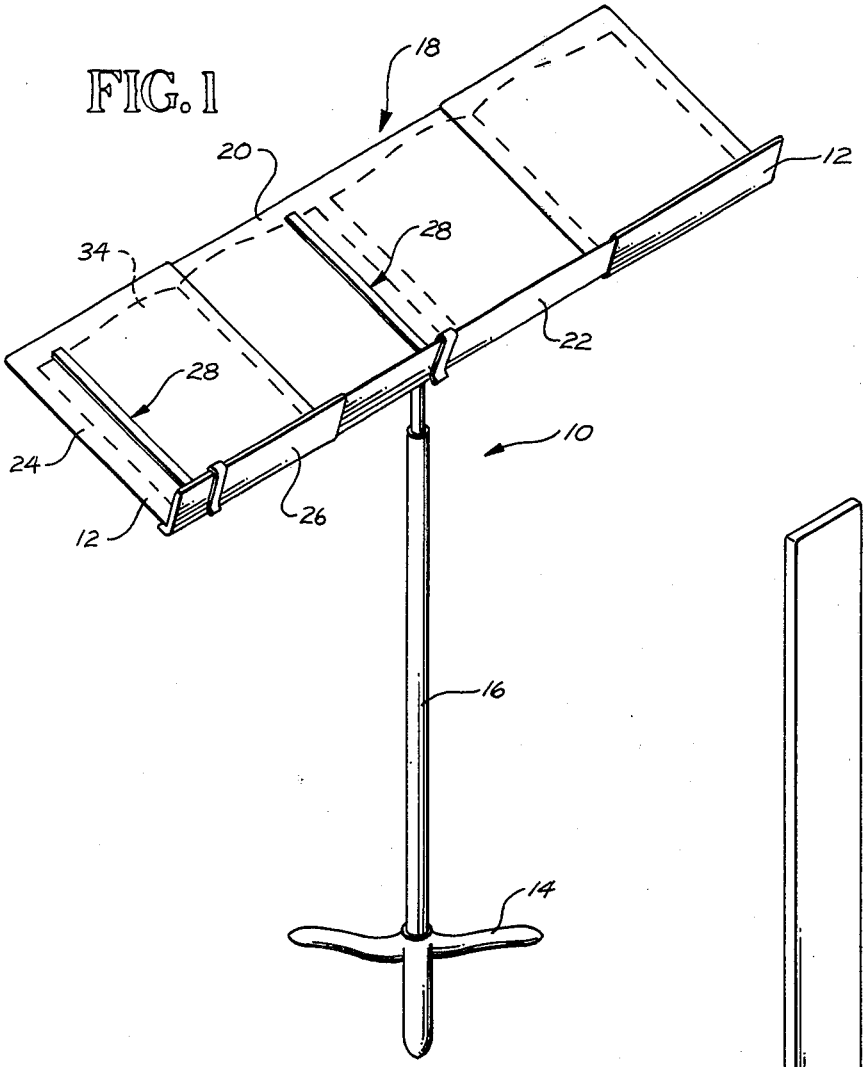
FIG. 1 is a isometric view of a conventional music stand having a pair of music stand extenders thereon, with two of the retaining devices of the present invention mounted thereon.
Figure 2:
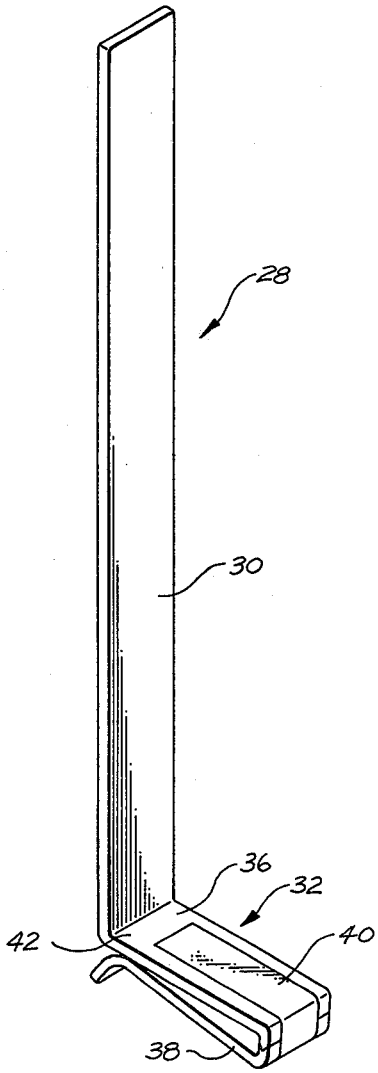
FIG. 2 is an isometric view of the retaining clip of the present invention in its assembled form.

FIG. 1 shows two of the retaining devices of the present invention mounted to a music stand 10. This music stand 10 is of conventional design, but has added thereto a pair of music stand extenders (i.e., extension wings) 12 which are described and claimed in my copending application, entitled "Music Stand Extender", Ser. No. 916,204, filed July 16, 1978. The music stand 10 with the extenders 12 is shown herein to illustrate that the retaining device of the present invention can be used not only with various music stands of conventional configuration, but also with the extenders 12 of my earlier invention.

The music stand 10 comprises a base 14, a telescoping column 16 and a sheet music support member 18, comprising a back support panel 20 and a lower support flange 22. The support flange 22 is or maybe made integral with the panel 20, and is connected by its lower inner edge to the lower edge of the support panel 20. The flange 22 extends outwardly from the panel 20, and is generally perpendicular to the panel 20. There is an adjustable fitting (not shown herein) interconnecting the panel 20 with the column 16 so that the angle of the panel 20 can be adjusted from a near vertical position to a near horizontal position. For convenience of description, the back support panel 20 shall be considered as positioned vertically (i.e., the plane of the panel 20 being positioned in a vertical plane), so that the terms "upper" and "lower" will be with reference to the plane of the panel 20 in the vertical position.

It is to be understood that the term "panel" as used herein is meant to refer more broadly to a planar support member which can be a single panel, or some other member which provides planar support. For example, the panel could also be a plurality of struts which can be moved to a collapsed position or to an expanded support position where they provide the function of a panel.

Each of the extension wings 12 comprise a main support panel 24, and two retaining flanges 26 which engage the lower support flange 22. These extension wings 12 can be slid outwardly to the extended position shown in FIG. 1, or slid inwardly to overlie and cover the back support panel 20.

The retaining device of the present invention is designated generally as 28, and two of these devices 28 are shown in FIG. 1 mounted to the stand 10, one directly to the support member 18, and another mounted directly to the extension wing 12. The retaining device 28 comprises generally a retaining arm 30 and a mounting portion 32. The retaining arm 30 comprises an elongate flat member which is adapted to be positioned against sheet music 34 that is supported against the panel 20 on the stand 10, with the retaining arm 30 extending vertically substantially the entire height of the back support panel 20.

The mounting portion 32 comprises an upper mounting flange 36, a lower mounting flange 38, and a spring member 40 which urges the two flanges 36 and 38 together. The upper mounting flange 36 is connected by its inner end 42 to the lower edge of the retaining arm 30, and extends outwardly therefrom so as to make an angle with the retaining arm 30 moderately greater than a right angle, when it is unflexed.

The upper and lower mounting flanges 36 and 38, respectively, engage each other at their outer end portions 44 and 46, respectively. The outer end 44 of the flange 36 is formed as an upper moderately downturned lip 48, while the outer end 46 of the lower flange 38 has a lower moderately unturned lip 50. The upper lip 48 has at its lower edge an elongate ridge 52 which fits in a matching groove 54 formed along the upper edge of the lower lip 50. The ridge 52 and groove 54 provide a hinge-like tongue and groove connection which permits moderate rotational movement between the flanges 36 and 38 about the axis of rotation located at the juncture line of the ridge 52 and groove 54.

The spring member 40 comprises an upper spring arm 56 and a lower spring arm 58 connected at inner ends thereof to a base portion 60. The arms 56 and 58, as well as the base 60, are made of flat, high strength spring steel. The length and width dimensions of the arms 56 and 58 are moderately less than the corresponding length and width dimensions of the flanges 36 and 38 so that the arms 56 and 58 can conveniently engage the upper end and lower surfaces, respectively, of the flanges 36 and 38. Further, the flanges 36 and 38 are formed with matching grooves 62 and 64, respectively, on their exposed surfaces to receive the arms 56 and 58. The base portion 60 is made just slightly larger than the combined vertical dimension of the two lips 48 and 50 (in their engaged position) so that the two spring arms 56 and 58 can properly engage the flanges 36 and 38 along most of the length thereof. The end portions of the spring arms 56 and 58 are bent moderately inwardly to apply most of the spring force at the inner ends of the flanges 36 and 38.

With the spring 40 mounted over the two flanges 36 and 38, the two spring arms 56 and 58 press the inner end 66 of the lower flange 38 upwardly toward the lower surface of the inner end 42 of the upper flange 38. It will be noted that the inner end 66 has a downwardly and rearwardly extending lip 68 which provides a flared or expanded opening 70. At the same time, the two lips 48 and 50 keep the outer ends 44 and 46 of the flanges 36 and 38 spaced a moderate distance away from one another. With this arrangement, the two mounting flanges 36 and 38 can be placed over music stand support flanges (such as flange 22 or the flanges 26, as described above) of various thickness dimensions.

To describe the operation of the present invention, let it be assumed that sheet music 34 has been placed upon the support member 18 of the music stand 10, so that the sheet music 34 extends not only over the back support panel 20, but also over the support panels 24 of the extension wings 12. One or more of the retaining devices 28 can be placed in operating position simply by positioning the retaining device 28 so that its flared opening 70 is adjacent the outer edge of the lower support flange 22. Then the mounting portion 32 of the device 28 is moved onto the support member 18, with the flange 22 of the support member 18 entering the opening 70 and passing between the two mounting flanges 36 and 38. In the fully mounted position, the flanges 36 and 38 grip the upper and lower sides of the flange 22, and the retaining arm is urged with moderate pressure against the sheet music 34 to press it against the back panel 20.

A second device 28 can be mounted to one of the extension wings 12 in the same manner. The flanges 36 and 38 are spaced sufficiently from one another so that there is no problem in accommodating the greater thickness dimension resulting from the two retaining flanges 26 of the extension wing 12 being spaced moderately from one another. Since the retaining arm 30 makes an angle with the upper mounting flange moderately greater than a ring angle, and with the usual support flange 22 making almost exactly a right angle with the back panel 20, the mounting portion 32 of the device 28 causes the retaining arm 30 to be urged with moderate pressure against the sheet music 34.

Each retaining device 28 can be moved out of engagement simply by pulling it outwardly from the support flanges 22 and 26. Since the retaining arm 30 is made of transparent plastic, there is no problem in the musician obtaining full view of the sheet music 34.

Figure 3:
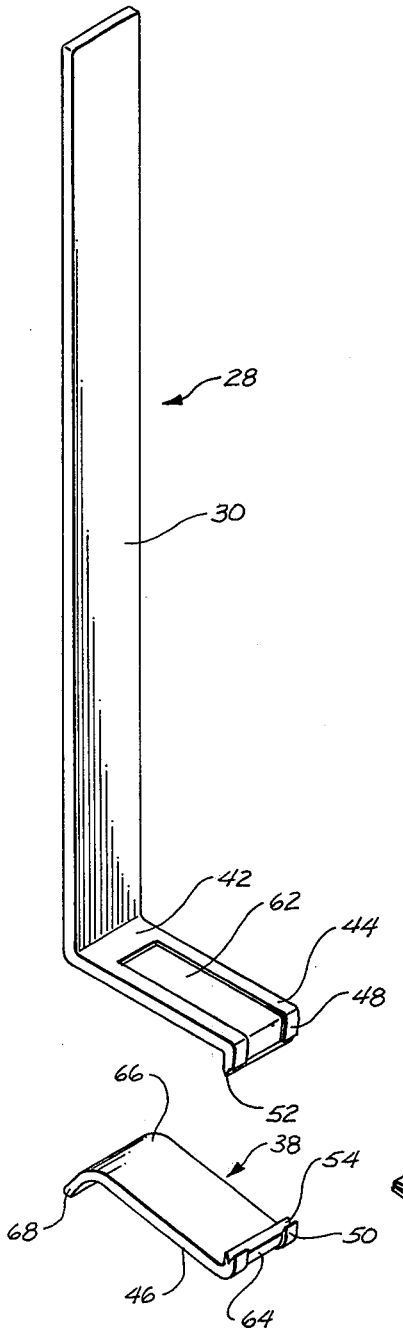
FIG. 3 is an isometric view showing the three component parts of the present invention separated from one another and ready for assembly.
Figure 4:
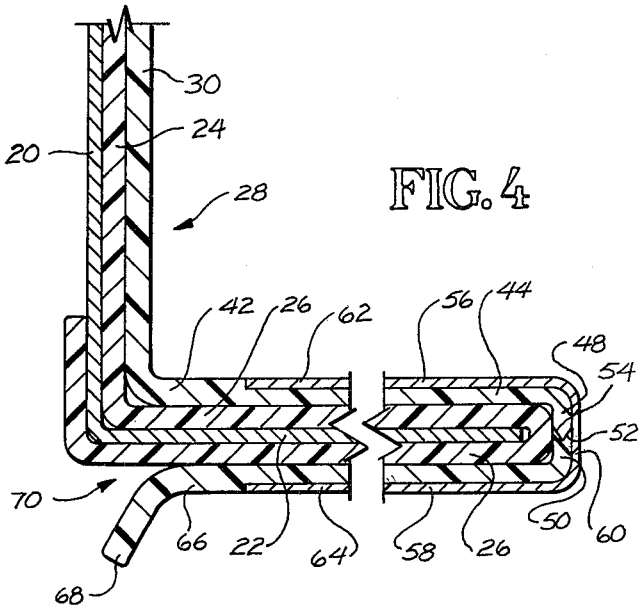
FIG. 4 is a sectional view taken along line 4—4 of FIG. 1, and showing the retaining device of the present invention mounted to an extension wing of the music stand.
Figure 5:
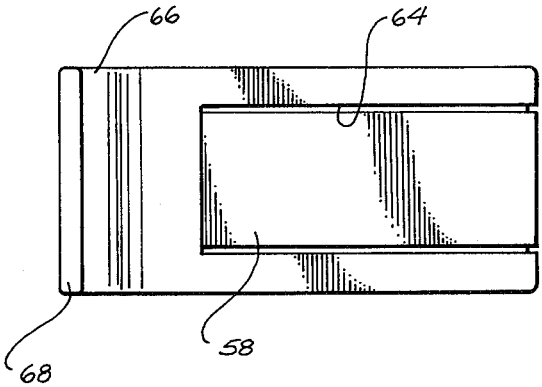
FIG. 5 is a bottom view of the retaining member in its position shown in FIG. 4.

Reference is now made to FIG. 3, which shows the preferred construction of the present invention, where it is made as three separate components. The first component is the retaining arm 30 and the upper mounting flange 36 which are molded or otherwise formed as a single integral plastic piece. The lower flange 38 is made as a separate plastic piece, and this has two advantages. First, it permits a simpler manufacturing process. Second, it enables the use of a quite convenient hinge connection, so that there is no problem of fatigue cracks which would otherwise occur after a period of time if the flanges 36 and 38 were molded as one integral part. The third component, namely the spring member 40, can be made as a separate metal piece, preferably of high-strength resilient steel, which not only can provide firm gripping action of the two flanges 36 and 38, but which can be deflected a great number of times without deteriorating.

Now therefore I claim:

1. A retaining device adapted to be mounted to a music stand, having a back panel portion and a lower support flange extending outwardly from a lower part of the panel portion, in a manner to support sheet music on the stand, said device comprising:

(a) a retaining arm having an upper end and a lower end, and adapted to be located in an upright retaining position to press said sheet music on the stand against the panel portion, (b) an upper mounting flange having an inner end connected to the lower end of the retaining arm, and an outer end extending outwardly from the retaining arm, and adapted to be positioned over the support flange of the stand, (c) a lower mounting flange having an outer end operatively connected to the outer end of the upper mounting flange and an inner end extending towards the inner end of the upper flange, and adapted to be positioned below the support flange of the stand, (d) said mounting flanges being arranged to grip the support flange of the music stand in a manner to hold the retaining arm in its retaining position, (e) said upper and lower flanges being operatively connected to one another at a hinge connection which permits moderate rotational movement between the upper and lower mounting flanges, (f) said upper and lower flanges being so arranged that said hinge connection is a tongue and groove connection, comprising a tongue member mounted to one of the mounting flanges, with the other of the mounting flanges being formed with a matching groove, (g) spring means engaging the upper and lower mounting flanges to urge the inner ends of the mounting flanges toward one another.

2. The device as recited in claim 1, wherein said spring means comprises an upper spring arm and a lower spring arm connected to one another through a base spring member, with the upper spring arm pressing downwardly against an upper surface of the upper mounting flange, and the lower spring arm pressing upwardly against the lower surface of the lower mounting flange.

3. A retaining device adapted to be mounted to a music stand, having a back panel portion and a lower support flange extending outwardly from a lower part of the panel portion, in a manner to support sheet music on the stand, said device comprising:

(a) a retaining arm having an upper end and a lower end, and adapted to be located in an upright retaining position to press said sheet music on the stand against the panel portion, (b) an upper mounting flange having an inner end connected to the lower end of the retaining arm, and an outer end extending outwardly from the retaining arm, and adapted to be positioned over the support flange of the stand, (c) a lower mounting flange having an outer end operatively connected to the outer end of the upper mounting flange and an inner end extending towards the inner end of the upper flange, and adapted to be positioned below the support flange of the stand, (d) said mounting flanges being arranged to grip the support flange of the music stand in a manner to hold the retaining arm in its retaining position, (e) spring means engaging the upper and lower mounting flanges to urge the inner ends of the mounting flanges toward one another, said spring means comprising an upper spring arm and a lower spring arm connected to one another through a base spring member, with the upper spring arm pressing downwardly against an upper surface of the upper mounting flange, and the lower spring arm pressing upwardly against the lower surface of the lower mounting flange.

4. The device as recited in claim 3, wherein at least one of said flanges is formed with a receiving groove to receive a related one of said spring arms.

5. The device as recited in claim 3, wherein each of said mounting flanges is provided with a related groove to receive its related spring arm of the spring means.

6. A retaining device adapted to be mounted to a music stand, having a back panel portion and a lower support flange extending outwardly from a lower part of the panel portion, in a manner to support sheet music on the stand, said device comprising:

(a) a retaining arm having an upper end and a lower end, and adapted to be located in an upright retaining position to press said sheet music on the stand against the panel portion, (b) an upper mounting flange having an inner end connected to the lower end of the retaining arm, and an outer end extending outwardly from the retaining arm, and adapted to be positioned over the support flange of the stand, (c) a lower mounting flange having an outer end operatively connected to the outer end of the upper mounting flange and an inner end extending towards the inner end of the upper flange, and adapted to be positioned below the support flange of the stand, (d) said mounting flanges being arranged to grip the support flange of the music stand in a manner to hold the retaining arm in its retaining position, (e) spring means engaging the upper and lower mounting flanges to urge the inner ends of the mounting flanges toward one another, (f) said retaining arm being made of a material which is at least translucent to permit musical figures to be read through the retaining arm, and said spring means being made of a high strength resilient material, (g) said retaining arm and said upper mounting flange being made as a single integral piece, said lower mounting flange being made as a separate piece, having hinge engagement with the upper mounting flange, and said spring means being made as a separate piece engaging the upper and lower mounting flange.

7. A retaining device adapted to be mounted to a music stand, having a back panel portion and a lower support flange extending outwardly from a lower part of the panel portion, in a manner to support sheet music on the stand, said device comprising:

(a) a retaining arm having an upper end and a lower end, and adapted to be located in an upright retaining position to press said sheet music on the stand against the panel portion, (b) an upper mounting flange having an inner end connected to the lower end of the retaining arm, and an outer end extending outwardly from the retaining arm, and adapted to be positioned over the support flange of the stand, (c) a lower mounting flange having an outer end operatively connected to the outer end of the upper mounting flange and an inner end extending towards the inner end of the upper flange, and adapted to be positioned below the support flange of the stand, (d) said mounting flanges being arranged to grip the support flange of the music stand in a manner to hold the retaining arm in its retaining position, (e) spring means engaging the upper and lower mounting flanges to urge the inner ends of the mounting flanges toward one another, (f) said retaining arm and said upper mounting flange being made as a single integral piece, said lower mounting flange being made as a separate piece, having hinge engagement with the upper mounting flange, and said spring means being made as a separate piece engaging the upper and lower mounting flanges.

* * * * *